United States Patent [19]

Niederer

[11] Patent Number: 4,778,118

[45] Date of Patent: Oct. 18, 1988

[54] YARN TENSION CONTROL APPARATUS AND METHOD

[75] Inventor: Kurt W. Niederer, Charlotte, N.C.

[73] Assignee: Belmont Textile Machinery Co., Inc., Belmont, N.C.

[21] Appl. No.: 84,407

[22] Filed: Aug. 10, 1987

[51] Int. Cl.[4] ..... B65H 51/26; B65H 51/30

[52] U.S. Cl. ..... 242/47.09; 242/47.01

[58] Field of Search ..... 242/47.08, 47.09, 47.1, 242/47.11, 47.01, 45, 18 R; 66/132 R, 132 T; 139/452

[56] References Cited

U.S. PATENT DOCUMENTS

| | | | |
|---|---|---|---|
| 1,849,983 | 3/1932 | Junkers | 242/47.09 |
| 2,350,182 | 5/1944 | Neff | 242/47.09 X |
| 2,641,913 | 6/1953 | Alric | 242/47.09 X |
| 2,746,281 | 5/1956 | Drisch et al. | 242/47.09 X |
| 2,819,582 | 1/1958 | Hill | 242/47.11 X |
| 2,896,572 | 7/1959 | Burke | 242/47.09 X |
| 3,119,572 | 1/1964 | Tata | 242/47.09 |
| 3,194,276 | 7/1965 | Krukonis et al. | 242/47.01 X |
| 3,491,963 | 1/1970 | Schlumpf | 242/47.01 |
| 3,912,184 | 10/1975 | Bous | 242/47.09 X |
| 3,957,218 | 5/1976 | Coats et al. | 242/47.09 X |
| 4,545,543 | 10/1985 | Plucknett | 242/47.01 |

*Primary Examiner*—Stanley N. Gilreath

*Attorney, Agent, or Firm*—W. Thad Adams, III

[57] ABSTRACT

A yarn tension control apparatus comprises a first feed roll having a substantially conically tapered yarn engaging roll surface, and including means for driving the first feed roll at a predetermined r.p.m. and a second feed roll having a substantially conically tapered yarn engaging roll surface, the second feed roll positioned in spaced-apart relation with the first feed roll for receiving a yarn wrapped successively around a circumference defined collectively by nonadjacent hemicylindrical roll surfaces of the first and second rolls, and including means for driving the second feed roll at the same predetermined r.p.m. as the first feed roll. The first and second feed rolls are aligned relative to each other so that the collectively defined circumference at any point on the yarn feeding surfaces of the first and second rolls is greater than the collectively defined circumference in one direction along the axis of rotation of the rolls, and less than the collectively defined circumference in the other direction along the axis of rotation of the rolls. As the wraps of yarn proceed along the axis of rotation of the first and second roll surfaces, the decreasing circumference of the first and second rolls reduces the rate of feed of the yarn relative to the yarn upstream therefrom and thereby reduces the tension on the yarn as it is fed off of the rolls and downstream therefrom.

10 Claims, 4 Drawing Sheets

YARN TENSION CONTROL APPARATUS AND METHOD

TECHNICAL FIELD AND BACKGROUND OF THE INVENTION

This invention relates to a yarn tension control apparatus and method. While the apparatus is adaptable to numerous uses and applications, the one discussed in this application for purposes of illustration is a yarn tension control apparatus which is used downstream of a yarn creel and upstream of a air jet entanglement texturizing machine. This type of machine is used to produce a soft, lustrous, fluffy yarn form "flat" multifilament continuous filament synthetic yarn. Tension control is crucial when supplying yarn to such machines, since excessive tension greatly reduces the effectiveness of the air on the fibers in causing them to entangle and loop in the proper manner. The result is a yarn which is second quality and which in subsequent manufacturing processes manifests itself in flat and shiny spots or bands in woven or knitted goods, and in dye shade variations.

As usually supplied to the texturizing machine, flat yarn is subject to substantial yarn tension variation. These differences may be due to differences in package size, with small packages generating higher tension; yarn path differences; yarn guide alignment and wear, and the distance the yarn must travel. Generally, the tension in the yarn as it is delivered to the texturizing machine should be minimal, since the texturizing process itself overfeeds the yarn to a predetermined extent to cause looping and entanglement of the yarns.

Tension on synthetic flat yarn beyond a minimal amount exhibits itself in elongation of the yarn. By estimating the elongation of the yarn from the creel and determining the elongation desired immediately upstream of the texturizing machine, a percentage of "excess elongation" can be determined. The goal is, then, to reduce the tension and hence the elongation of the yarn in a reasonably predictable manner to a desired degree.

SUMMARY OF THE INVENTION

Therefore, it is an object of the invention to provide an apparatus for controlling yarn tension in a yarn processing operation.

It is another object of the invention to provide an apparatus for reducing yarn tension in advance of supplying the yarn to a texturizing machine, such as an air jet entanglement machine.

It is another object of the invention to provide an apparatus for reducing yarn tension which includes feedback means for regulating the degree to which tension is reduced in response to exit yarn tension to provide a constant output tension.

It is another object of the invention to provide an apparatus for reducing yarn tension which includes means for varying the range of tension to which the apparatus is responsive.

It is yet another object of the invention to provide a method of controlling or reducing yarn tension which may be performed with an apparatus according to this invention.

These and other objects of the present invention are achieved in the preferred embodiments disclosed below by providing a yarn tension control apparatus comprising a first feed roll having a substantially conically tapered yarn engaging roll surface, and including means for driving the first feed roll at a predetermined r.p.m. A second feed roll having a substantially conically tapered yarn engaging roll surface is provided, the second feed roll positioned in spaced-apart relation with the first feed roll for receiving a yarn wrapped successively around a circumference defined collectively by nonadjacent hemicylindrical roll surfaces of the first and second rolls. Means drive the second feed roll at the same predetermined r.p.m. as the first feed roll. The first and second feed rolls are aligned relative to each other so that the collectively defined circumference at any point on the yarn feeding surfaces of the first and second rolls is greater than the collectively defined circumference in one direction along the axis of rotation of the rolls, and less than the collectively defined circumference in the other direction along the axis of rotation of the rolls.

As the wraps of yarn proceed along the axis of rotation of the first and second roll surfaces, the decreasing circumference of the first and second rolls reduces the rate of feed of the yarn relative to the yarn upstream therefrom and thereby reduces the tension on the yarn as it is fed off of the rolls and downstream therefrom.

According to one preferred embodiment of the invention, the axis of rotation of the second feed roll is at a slight angle relative to the axis of rotation of the first feed roll to provide a slightly different roll circumference on the second roll at the point of transfer of the yarn from the second roll to the first roll and thereby permit spacing of the yarn along the length of the rolls from the larger circumference end of the rolls to the smaller circumference end of the rolls.

According to another preferred embodiment of the invention, a closed loop tension feedback control means varies the length of the rolls along which the yarn is wrapped and the amount of decrease in the rate of feed of the yarn as a function of the tension on the yarn as it exits the yarn tension control apparatus.

Preferably, the tension feedback control means comprises an input yarn guide for receiving the yarn from an upstream yarn source such as a creel and applying the yarn to the first and second feed rolls at a predetermined point along the yarn engaging roll surface. An exit yarn guide receives the yarn from the feed rolls at reduced tension and delivers the yarn to a downstream yarn process.

Means interconnect the input yarn guide and the exit yarn guide and move the input yarn guide along the yarn engaging roll surface to a point of increased diameter in response to an increase in tension on the yarn at the exit guide and to a point of decreased diameter in response to a decrease in tension on the yarn at the exit guide. According to yet another embodiment of the invention, means vary the resistance of the exit yarn guide to the exit yarn tension and thereby control the degree of feedback control exercised by the exit yarn guide over the input yarn guide.

According to another embodiment of the invention, the first and second feed rolls have different diameters, and the means for driving the second feed roll drives the feed roll at a speed which provides to the second drive roll approximately the same surface speed of the first feed roll.

According to another preferred embodiment of the invention, the means for driving the second feed roll comprises the yarn.

According to yet another embodiment of the invention, a first feed roll is provided having a substantially conically tapered yarn engaging roll surface, and including means for driving the first feed roll at a predetermined r.p.m. A second feed roll is positioned in spaced-apart relation with the first feed roll for receiving a yarn wrapped successively around a circumference defined collectively by nonadjacent hemicylindrical roll surfaces of the first and second rolls. The second feed roll comprises a plurality of coaxial, independently rotatable idler discs having a concave perimeter defining a yarn engaging surface for receiving respectively, successive wraps of yarn from the first feed roll and being driven by the wraps of yarn at a surface speed resulting from the speed and elongation of the yarn. The first and second feed rolls are aligned relative to each other so that the collectively defined circumference at any point on the yarn feeding surfaces of the first and second rolls is greater than the collectively defined circumference in one direction along the axis of rotation of the rolls, and less than the collectively defined circumference in the other direction along the axis of rotation of the rolls.

The method of controlling yarn tension in accordance with the invention comprising the steps of providing a first feed roll having a substantially conically tapered yarn engaging roll surface for being driven at a predetermined r.p.m. and a second feed roll having a substantially conically tapered yarn engaging roll surface, the second feed roll positioned in spaced-apart relation with the first feed roll and including means for driving the second feed roll at the same predetermined r.p.m. as the first feed roll.

The first and second feed rolls are aligned relative to each other so that a collectively defined circumference at any point on the yarn feeding surfaces of the first and second rolls is greater than the collectively defined circumference in one direction along the axis of rotation of the rolls, and less than the collectively defined circumference in the other direction along the axis of rotation of the rolls. A yarn is wrapped successively around a circumference defined collectively by the nonadjacent hemicylindrical roll surfaces of the first and second rolls. As the wraps of yarn proceed along the axis of rotation of the first and second roll surfaces, the decreasing circumference of the first and second rolls reduces the rate of feed of the yarn relative to the yarn upstream therefrom and thereby reduces the tension on the yarn as it is fed off of the rolls and downstream therefrom.

Preferably, the axis of rotation of the second feed roll is at a slight angle relative to the axis of rotation of the first feed roll to provide a slightly different roll circumference on the second roll at the point of transfer of the yarn from the second roll to the first roll and thereby permit spacing of the yarn along the length of the rolls from the larger circumference end of the rolls to the smaller circumference end of the rolls. According to one preferred embodiment of the invention, the method includes the step of varying the length of the rolls along which the yarn is wrapped and the amount of decrease in the rate of feed of the yarn as a function of the tension on the yarn as it exits the yarn tension control apparatus.

According to one preferred embodiment of the invention, the step of varying the length of the rolls along which the yarn is wrapped comprises receiving the yarn from an upstream yarn source such as a creel and applying the yarn to the first and second feed rolls at a predetermined point along the yarn engaging roll surface, receiving the yarn from the feed rolls at reduced tension and delivering the yarn to a downstream yarn process, and moving the predetermined point where the yarn is applied to the first and second feed rolls to a point of increased diameter in response to an increase in tension on the yarn at the exit guide and to a point of decreased diameter in response to a decrease in tension on the yarn at the exit guide.

BRIEF DESCRIPTION OF THE DRAWINGS

Some of the objects of the invention have been set forth above. Other objects and advantages of the invention will appear as the description of the invention proceeds when taken in conjunction with the following drawings, in which.

DESCRIPTION OF THE PREFERRED EMBODIMENT

Figure 1:
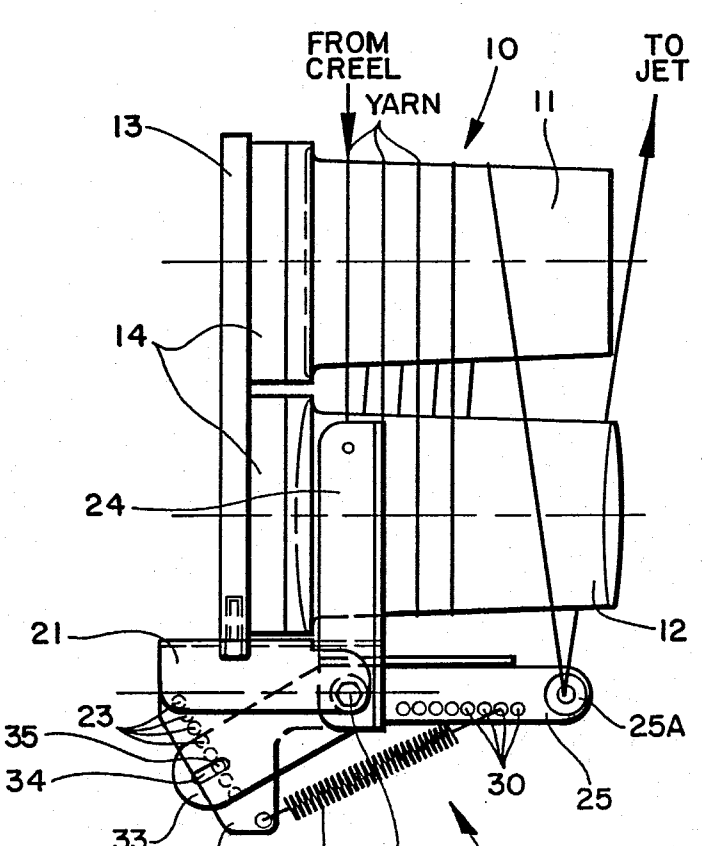
FIG. 1 is a side elevation view of a yarn tension control apparatus according to one embodiment of the invention.

Referring now specifically to the drawings, a yarn tension control apparatus according to the present invention is illustrated in FIG. 1 and shown generally at reference numeral 10. Apparatus 10 has application in numerous processes where it is necessary or desirable to decrease the tension of a moving yarn before delivering it to a further processing step. In this application and for purposes of illustration, the yarn tension control apparatus 10 will be described in a process where flat continuous multi-filament synthetic yarn is delivered from an upstream creel to an air jet entanglement texturizing machine. In this type of texturizing process, it is desirable to have the tension on the yarn at a relatively low and uniform level since the process relies on the ability of the air jet to increase the bulk of the yarn by forming a multitude of random loops and tangles in the yarn, and tension resists the formation of the loops and tangles. Low tension can be easily achieved at low yarn travel speeds. However, for the process to be economically productive, the yarn must travel at a high rate of speed, thereby increasing tension. Therefore, the yarn tension control apparatus 10 is interposed in the process stream between the creel and the air jet texturizer.

Still referring to FIG. 1, yarn tension control apparatus 10 comprises two spaced-apart feed rolls 11 and 12. In the particular embodiment shown in FIG. 1, both feed rolls 11 and 12 are mounted on a frame 13 and are driven through suitable power transmission means, shown generally at 14, at the same predetermined rotational speed. Alternatively, one of the rolls, usually the top roll 11, can the driven, and the bottom roll can be an idler. Both feed rolls 11 and 12 have a slightly tapered, conical yarn engaging circumference. While the degree of taper is variable, a five degree (5°) taper is suitable.

Figure 2:
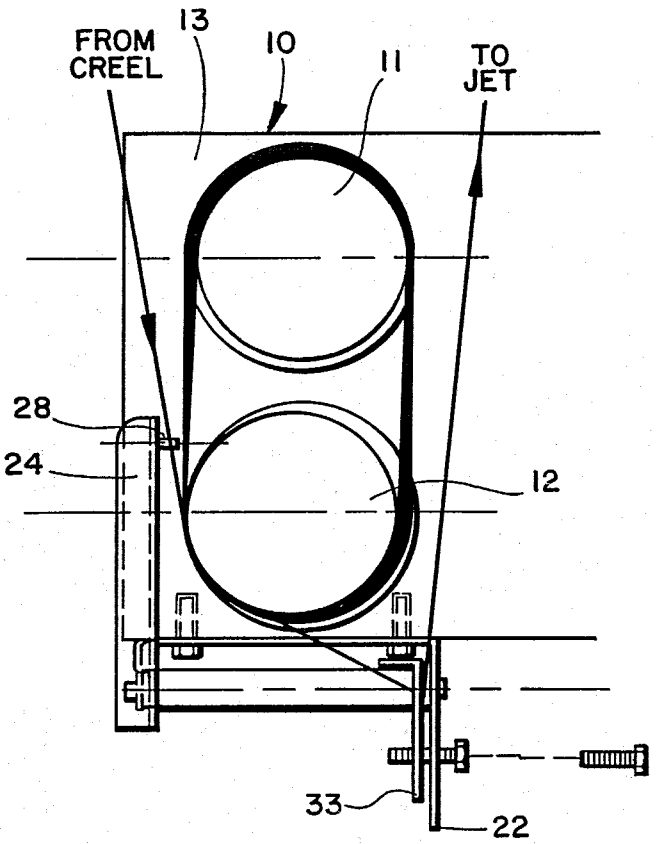
FIG. 2 is an end elevation view of the apparatus shown in FIG. 1.

The axis of rotation of the bottom feed roll 12 is at a slight angle as is shown in both FIGS. 1 and 2. The effect of this is to provide on the bottom feed roll 12 a slightly greater roll circumference at the point of transfer of the yarn from the bottom roll 12 to the top roll 11, thereby spacing the yarn along the rolls 11 and 12 from left to right, as shown in FIG. 1.

Enough wraps of the yarn are placed around rolls 11 and 12 so that positive feeding of the yarn is achieved. The effect of the spacing of the yarn along the length of the rolls 11 and 12 with their gradually decreasing circumferences is to decrease the rate of travel of the yarn as it moves from left to right. The reduced surface speed of the rolls 11 and 12 from left to right also reduces the speed and the tension on the yarn being positively fed by rolls 11 and 12. Tension reduction is a direct result of the decrease in elongation of the yarn as it moves along the decreasing circumferences of rolls 11 and 12. As is apparent, the alignment of the rolls 11 and 12 with each collectively define a single circumference at any point on the yarn feeding surfaces of the rolls, with that collective circumference decreasing as the yarn travels along the rolls 11 and 12 from one end to the other.

The reduction in elongation and therefore tension achieved in the yarn is controlled by the length of the rolls 11 and 12 along which the yarn is permitted to travel. Reduction in elongation is directly functionally related to the reduction in roll circumference. Therefore, to reduce the elongation of the yarn by 10%, the yarn will theoretically be taken off rolls 11 and 12 at a point where the circumference of the rolls is 10% less than where the yarn was put on, with allowances made for empirically determined variables such as roll slippage being taken into account.

Preferably, the yarn is taken off of roll 12 at about the same place. Therefore, tension reduction is achieved by varying the position where the yarn is put on the rolls 11 and 12. This can be done in a number of ways.

In FIG. 1, an automatic tension controller 20 permits servo control of tension by feedback from the point where the yarn is taken off of the rolls 11 and 12. Tension controller 20 includes a mounting plate 21 which is stationarily mounted to apparatus 10. Mounting plate 21 has a downwardly extending adjustment member 22 with a plurality of spaced-apart adjustment holes 23.

A substantially upright input yarn guide 24 and an exit yarn guide 25 are fixed together at substantial right angles and are pivotally mounted to mounting plate 21 by a pivot pin 26. The yarn passes through a guide ring **25*a* in exit yarn guide 25. As is best shown in FIG. 2, input yarn guide includes a yarn guide ring 28 through which the yarn passes. A tension spring 29 is connected to the pivotally mounted exit yarn guide 25 by means of one of several adjustment holes 30 and to stationary adjustment member 22 by a hole 31 therein. The tension created by the spring 29** provides a selective degree of sensitivity and resistance to tension in the yarn.

Figure 3:
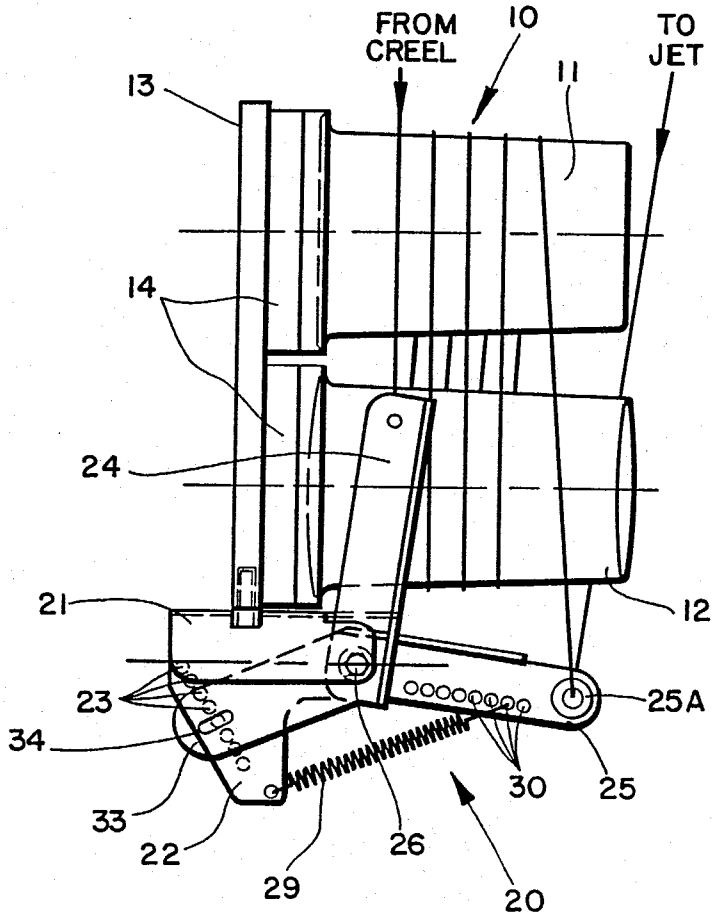
FIG. 3 is a side elevation view similar to that in FIG. 1, but showing the tension adjustment in a different position.

The amount of tension reduction can be controlled by a manual or feedback adjustment. The manual adjustment is achieved by positioning the input yarn guide 24 at a fixed position. An adjustment finger 33 fixed to both the input and exit yarn guides 24, 25 is positioned by means of a slot 34 therein in registration with one of the holes 23 in adjustment plate 22 and locked in that position by a pin 35. As is best shown by comparing the views in FIGS. 1 and 3, movement of adjustment finger 33 causes a substantial movement of the input yarn guide 24 along the axis of rotation of roll 12. At the same time, almost no axial movement of exit guide 25 occurs, since it lies in a plane perpendicular to input guide 24. As a result, an upward adjustment of adjustment finger 33 shifts substantially to the right, the point at which the yarn is put onto the roll 11 without changing the point at which the yarn passes through the guide ring **25*a* and to the texturizer. With the input yarn guide locked in the position shown in FIG. 3, the rate of yarn feed is less because the circumference of rolls 11 and 12** at that point is less.

Feedback tension control is achieved by removing pin 35, and thereby allowing the input and exit yarn guides 24, 25 to move in response to tension variations. By further reference to FIG. 1, a particular tension on the yarn will cause the input and exit yarn guides 24, 25 to achieve the position shown. A decrease in tension on the yarn will cause the exit yarn guide to be pulled downwardly slightly by the constant resistance of spring 29. Input yarn guide 24 moves to the right and applies the yarn to the roll 11 at a point of reduced circumference, thereby reducing the input feed rate and increasing the tension to a corresponding degree. Likewise, an increase in tension will move the input yarn guide 24 back to the left to a point where the yarn is applied to roll at a point of increased circumference, thereby increasing the input feed rate and decreasing the tension to a corresponding degree.

Figure 5:
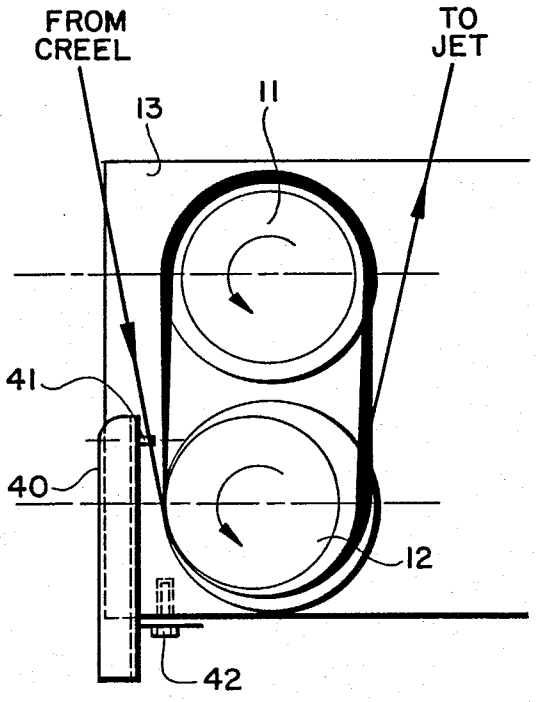
FIG. 5 is an end elevation view according to FIG. 4.
Figure 4:
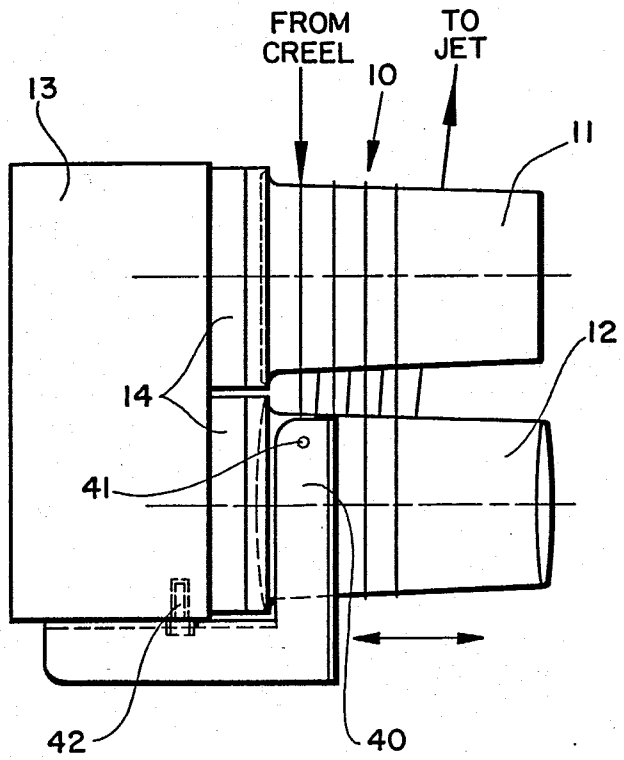
FIG. 4 is a side elevation view of a yarn tension apparatus having manual tension adjustment.

Referring now to FIGS. 4 and 5, a completely manual tension adjustment device is shown, with no provision made for feedback tension control. An input yarn guide 40 having a guide ring 41 is mounted to the frame 13 by a bolt 42 integrally formed adjustment bracket 43 with a plurality of adjustment holes (not shown) therein. Tension changes are made by simply moving the bracket 43 so that the bolt 42 passes through a different hole.

Figure 7:
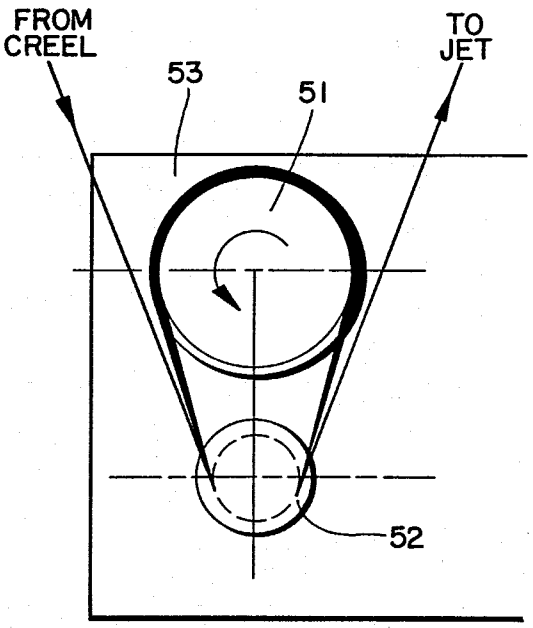
FIG. 7 is an end view of the apparatus shown in FIG. 6.
Figure 6:
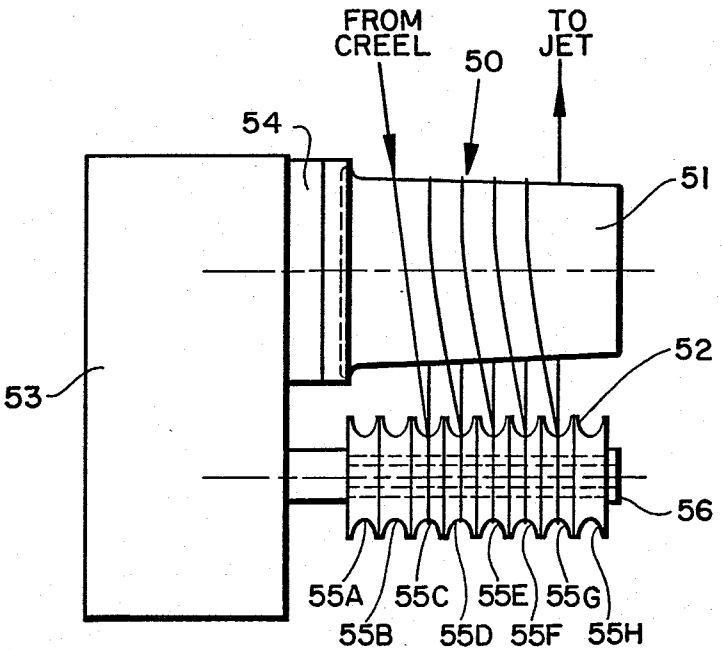
FIG. 6 is a side elevation view of a tension control apparatus wherein the bottom, or second feed roll is formed of a number of idler discs.

Another embodiment of the invention is shown in FIGS. 6 and 7. Yarn tension control apparatus 50 comprises two spaced-apart feed rolls 51 and 52. In the embodiment shown in FIG. 6, feed rolls 51 and 52 are mounted on a frame 53. Feed roll 51 is driven through suitable power transmission means, shown generally at 54, at a predetermined rotational speed. The bottom roll 52 is an idler, and is driven only by the friction of the yarn. Feed roll 51 has a slightly tapered, conical yarn engaging circumference. While the degree of taper is variable, a five degree (5°) taper is suitable.

Feed roll 52 is constructed of a plurality of discs **55*a*–55*h* concentrically mounted by suitable bearings (not shown) for rotation on a shaft 56. Each of the discs 55*a*–55*h* has a concave, yarn engaging perimeter. As is shown in FIG. 6, spacing along the length of roll 51 is achieved by feeding the yarn from roll 51 into a predetermined axially offset one of the discs 55*a*–55*h* as the yarn proceeds from left to right. The effective circumference of the rolls 51 and 52 decreases, causing a decrease in feed rate and a corresponding decrease in elongation and tension. While all of the discs 55*a*–55*h*, as shown in FIG. 6, have the same yarn engaging perimeter, the discs can be provided with a gradually decreasing perimeter. Spacing of the yarn on roll 51 can be varied by varying the width of the discs and/or by angling the axis of roll 51 relative the roll 52**.

A method and apparatus for controlling yarn tension is described above. Various details of the invention may be changed without departing from its scope. Furthermore, the foregoing description of the preferred embodiment according to the present invention is provided for the purpose of illustration only and not for the purpose of limitation—the invention being defined by the claims.

I claim:

1. A yarn tension control apparatus, comprising:

(a) a first feed roll having a substantially conically tapered yarn engaging roll surface, and including means for driving said first feed roll at a predetermined r.p.m.;

(b) a second feed roll having a substantially conically tapered yarn engaging roll surface, said second feed roll positioned in spaced-apart relation with said first feed roll for receiving a yarn wrapped successively around a circumference defined collectively by nonadjacent hemicylindrical roll surfaces of said first and second rolls, and including means for driving said second feed roll;

(c) said first and second feed rolls being aligned relative to each other so that the collectively defined circumference at any point on the yarn feeding surfaces of said first and second rolls is greater than the collectively defined circumference in one direction along the axis of rotation of the rolls, and less than the collectively defined circumference in the other direction along the axis of rotation of the rolls, whereby as the wraps of yarn proceed along the axis of rotation of said first and second roll surfaces, the decreasing circumference of said first and second rolls reduces the rate of feed of the yarn relative to the yarn upstream therefrom and thereby reduces the tension on the yarn as it is fed off of the rolls and downstream therefrom; and (d) closed loop tension feedback control means for varying the amount of decrease in the rate of feed of the yarn in proportion to the tension on the yarn as it exits the yarn tension control apparatus.

2. A yarn tension control apparatus according to claim 1, wherein the axis of rotation of said second feed roll is at a slight angle relative to the axis of rotation of said first feed roll to provide spacing of the yarn along the length of the rolls from the larger circumference end of the rolls to the smaller circumference end of the rolls.

3. A yarn tension control apparatus according to claim 1 or 2 wherein said tension feedback control means comprises:

(a) an input yarn guide for receiving the yarn from an upstream yarn source such as a creel and applying the yarn to the first and second feed rolls at a predetermined point along the yarn engaging roll surface;

(b) an exit yarn guide for receiving the yarn from the feed rolls at reduced tension and delivering the yarn to a downstream yarn process;

(c) means interconnecting said input yarn guide and said exit yarn guide for moving the input yarn guide along the yarn engaging roll surface to a point of increased diameter in proportionate response to an increase in tension on the yarn at the exit guide and to a point of decreased diameter in proportionate response to a decrease in tension on the yarn at the exit guide.

4. A yarn tension control apparatus according to claim 3, and including means for varying the resistance of the exit yarn guide to the exit yarn tension and thereby controlling the degree of feedback control exercised by the exit yarn guide over the input yarn guide.

5. A yarn tension control apparatus according to claim 4, wherein said means interconnecting said input yarn guide and said exit yarn guide comprises pivot means.

6. A yarn tension control apparatus according to claim 1, wherein said first and second feed rolls have different diameters, and said means for driving said second feed roll drives said feed roll at a speed which provides to said second drive roll approximately the same surface speed of said first feed roll.

7. A yarn tension control apparatus according to claim 1, wherein said means for driving said second feed roll comprises the yarn.

8. A method of controlling yarn tension, comprising the steps of:

(a) providing a first feed roll having a substantially conically tapered yarn engaging roll surface for being driven at a predetermined r.p.m.;

(b) providing a second feed roll having a substantially conically tapered yarn engaging roll surface, said second feed roll positioned in spaced-apart relation with said first feed roll and including means for driving said second feed roll at the same predetermined r.p.m. as said first feed roll;

(c) aligning said first and second feed rolls relative to each other so that a collectively defined circumference at any point on the yarn feeding surfaces of said first and second rolls is greater than the collectively defined circumference in one direction along the axis of rotation of the rolls, and less than the collectively defined circumference in the other direction along the axis of rotation of the rolls;

(d) wrapping a yarn successively around a circumference defined collectively by the nonadjacent hemicylindrical roll surfaces of said first and second rolls;

(e) varying the length of the rolls along which the yarn is wrapped and the amount of decrease in the rate of feed of the yarn in proportion to the tension on the yarn as it exits the rolls; and (f) whereby, as the wraps of yarn proceed along the axis of rotation of said first and second roll surfaces, the decreasing circumference of said first and second rolls reduces the rate of feed of the yarn relative to the yarn upstream therefrom and thereby reduces the tension on the yarn as it is fed off of the rolls and downstream therefrom.

9. A method of controlling yarn tension according to claim 8, and including the step of angling the axis of rotation of said second feed roll slightly relative to the axis of rotation of said first feed roll to provide a slightly different roll circumference on said second roll at the point of transfer of said yarn from said second roll to said first roll and thereby permit spacing of the yarn along the length of the rolls from the larger circumference end of the rolls to the smaller circumference end of the rolls.

10. A method of controlling yarn tension according to claim 9, wherein the step of varying the length of the rolls along which the yarn is wrapped comprises:

(a) receiving the yarn from an upstream yarn source such as a creel and applying the yarn to the first and second feed rolls at a predetermined point along the yarn engaging roll surface;

(b) receiving the yarn from the feed rolls at reduced tension and delivering the yarn to a downstream yarn process; and (c) moving the predetermined point where the yarn is applied to the first and second feed rolls to a point of increased diameter in proportionate response to an increase in tension on the yarn at the exit guide and to a point of decreased diameter in proportionate response to a decrease in tension on the yarn at the exit guide.

* * * * *